US006494352B1

(12) United States Patent
Mullen

(10) Patent No.: US 6,494,352 B1
(45) Date of Patent: Dec. 17, 2002

(54) MULTI-MODE GOLF BAG TRAVEL SYSTEM

(75) Inventor: Rick L. Mullen, Wausau, WI (US)

(73) Assignee: Golfins LLC, Wausau, WI (US)

( * ) Notice: Subject to any disclaimer, the term of this patent is extended or adjusted under 35 U.S.C. 154(b) by 0 days.

(21) Appl. No.: 09/675,701

(22) Filed: Sep. 29, 2000

(51) Int. Cl.[7] ..... B60R 7/00

(52) U.S. Cl. ..... 224/524; 224/521; 206/315.7; 280/37; 280/47.26

(58) Field of Search ..... 224/519, 521, 224/524, 527; 206/315.3, 315.7; 280/37, 47.26

(56) References Cited

U.S. PATENT DOCUMENTS 5,071,147 A * 12/1991 Stansbury ..... 280/47.19
5,372,287 A 12/1994 Deguevara
5,400,933 A 3/1995 Murray
5,556,064 A 9/1996 Cowe
5,806,738 A 9/1998 D'Angelo
5,921,387 A * 7/1999 Arzoomanian et al. .. 206/315.4
6,039,227 A * 3/2000 Stark ..... 224/521
6,039,243 A * 3/2000 Lickton ..... 229/117.01
D432,488 S 10/2000 Roll et al.
D437,578 S * 2/2001 Stannard-Warne ..... D12/406
6,186,522 B1 * 2/2001 Weis ..... 280/37
6,217,042 B1 * 4/2001 Kurtz et al. ..... 280/37
6,253,981 B1 * 7/2001 McLemore ..... 224/526

OTHER PUBLICATIONS

Web page, Sweet Spot Golf, Hard Golf Bag Travel Cases, pp. 1–3, copyright 1999.*

* cited by examiner

*Primary Examiner*—Stephen K. Cronin
(74) *Attorney, Agent, or Firm*—Faegre & Benson LLP

(57) ABSTRACT

A golf bag travel system which can be used in both a vehicle-mounted mode and a travel mode. The system includes a vehicle base adapted to be mounted to a vehicle, a travel base having wheels, and a cover which mates with both the vehicle base and the travel base. A multi-point lock releasably secures the cover to either the vehicle base or the travel base.

20 Claims, 10 Drawing Sheets

MULTI-MODE GOLF BAG TRAVEL SYSTEM

FIELD OF THE INVENTION

The present invention is a carrier for golf bags and other articles.

BACKGROUND OF THE INVENTION

Vehicle-mounted golf bag carriers are generally known and disclosed, for example, in the Murray U.S. Pat. No. 5,400,933 and the D'Angelo U.S. Pat. No. 5,806,738. Hard shell cases for golf bags are also known and often used when the bags are transported by plane.

There remains, however, a continuing need for improved golf bag travel systems. Vehicle-mounted and travel case golf bag carriers which are efficient to manufacture and convenient to use would be especially desirable. To be commercially viable, the carriers should also be attractive in appearance.

SUMMARY OF THE INVENTION

The present invention is a golf bag travel system which provides a high degree of protection for golf bags and is very convenient to use. The system is also efficient to manufacture.

One embodiment of the invention is a multi-mode golf bag travel system. The system includes a vehicle base adapted to be mounted to a vehicle, a travel base having wheels, and a hard shell cover for enclosing a golf bag. The cover has an opening at a first end which mates with both the vehicle base and the travel base, and a handle adjacent to a second end. A locking mechanism secures the hard shell cover to the vehicle base when the system is used in a vehicle mode, and secures the cover to the travel base when used in a travel mode.

DETAILED DESCRIPTION OF THE PREFERRED EMBODIMENTS

Figure 1:
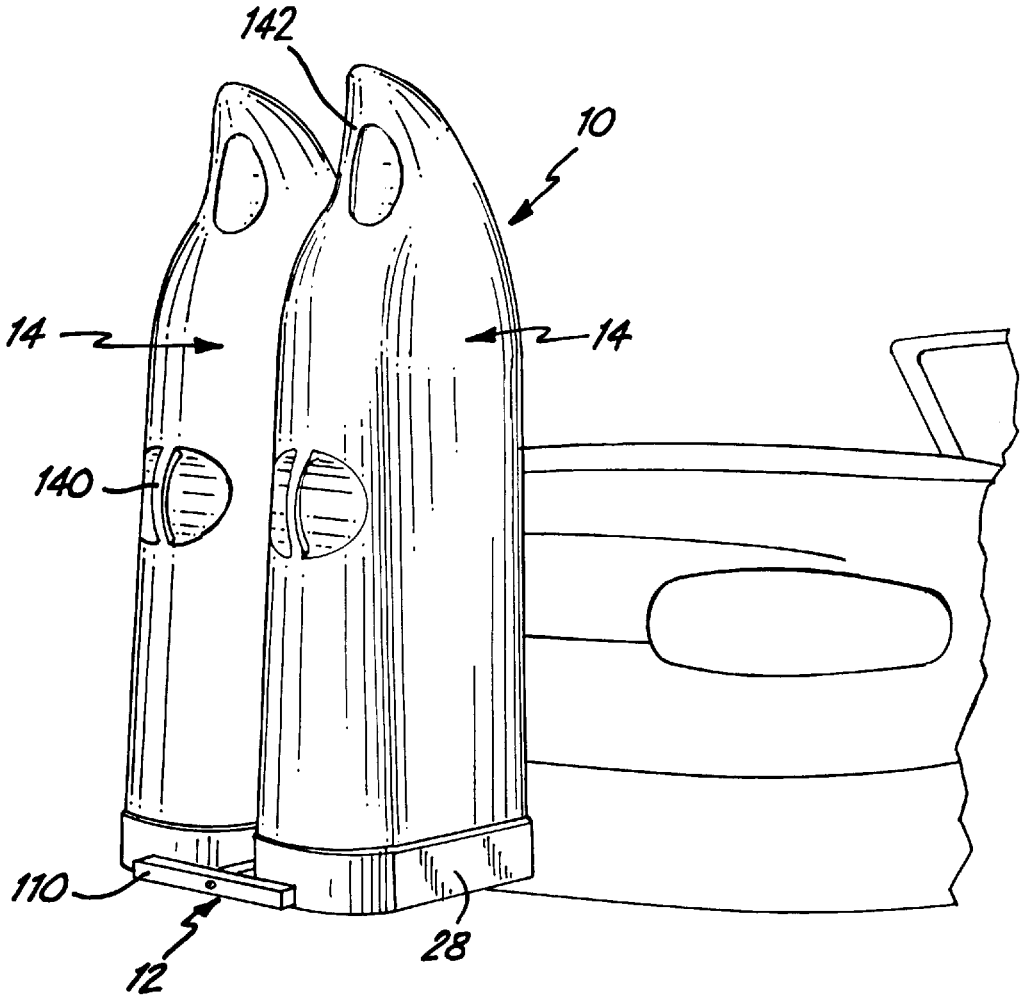
FIG. 1 is an isometric view of a vehicle-mounted version of a multi-mode golf bag travel system in accordance with the present invention, shown mounted to the back of a vehicle.
Figure 2:
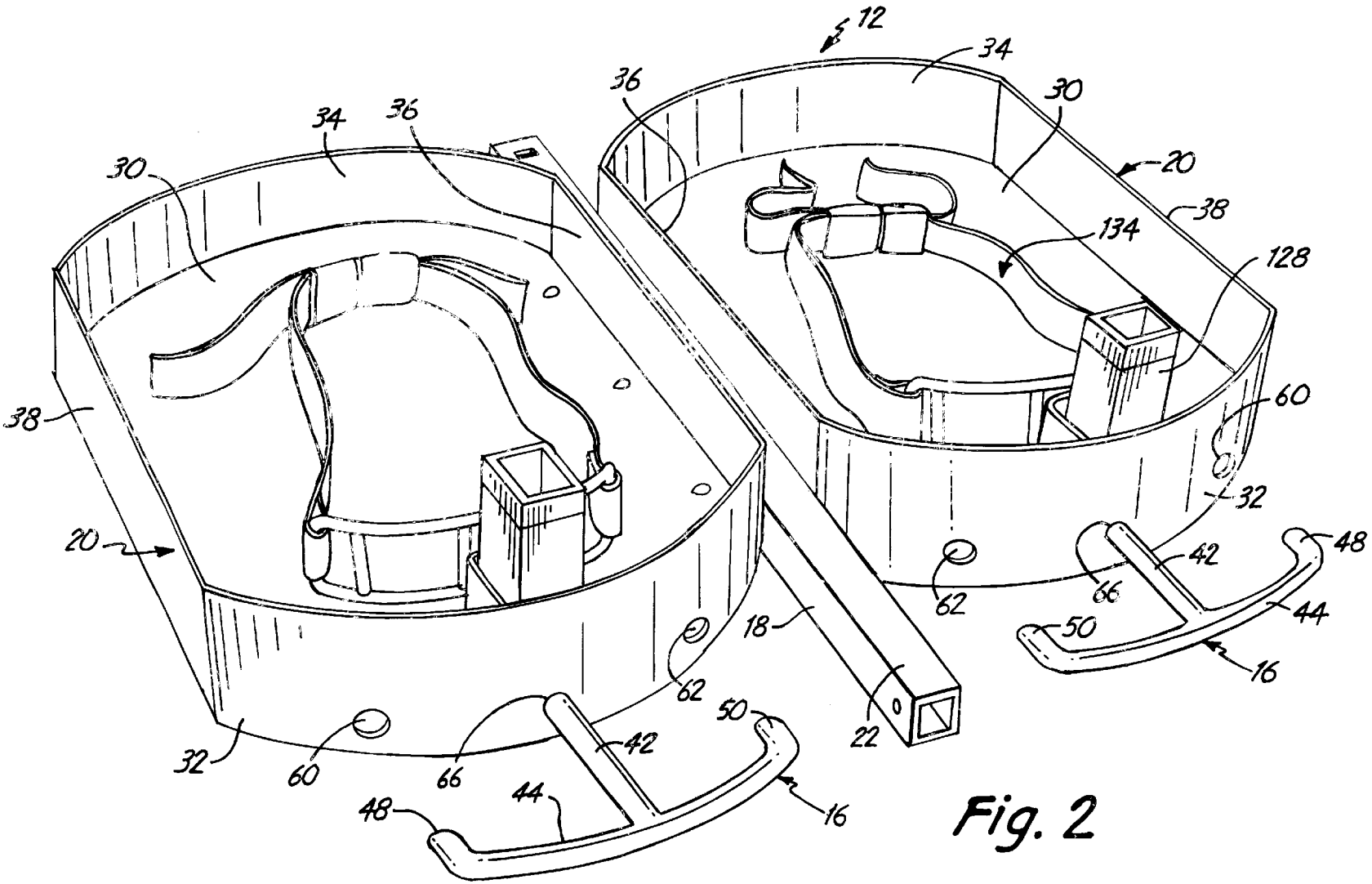
FIG. 2 is an isometric view of the top side of the base assembly of the travel system shown in FIG. 1.
Figure 3:
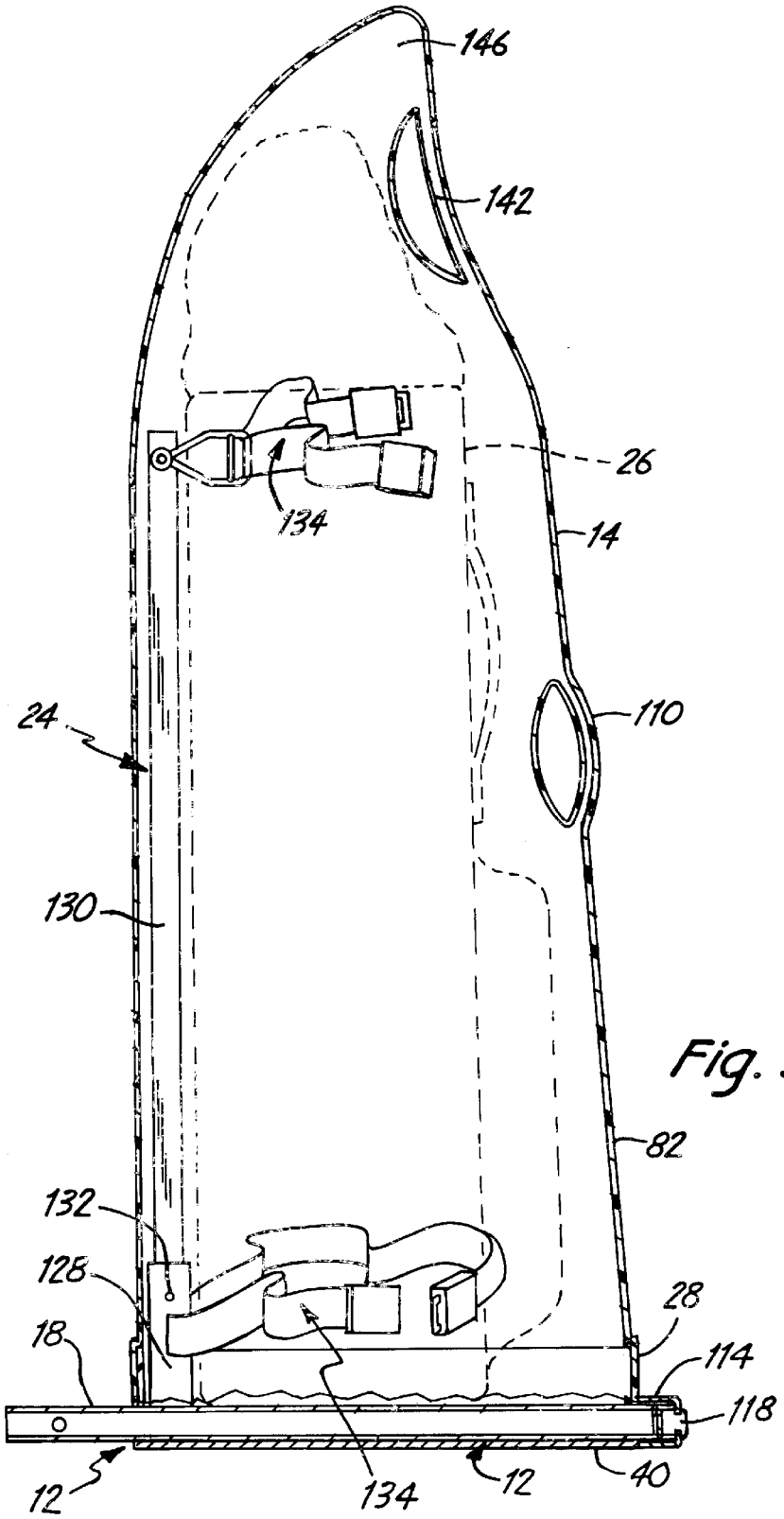
FIG. 3 is a sectional view of the travel system shown in FIG. 1, with a golf bag shown in phantom.
Figure 4:
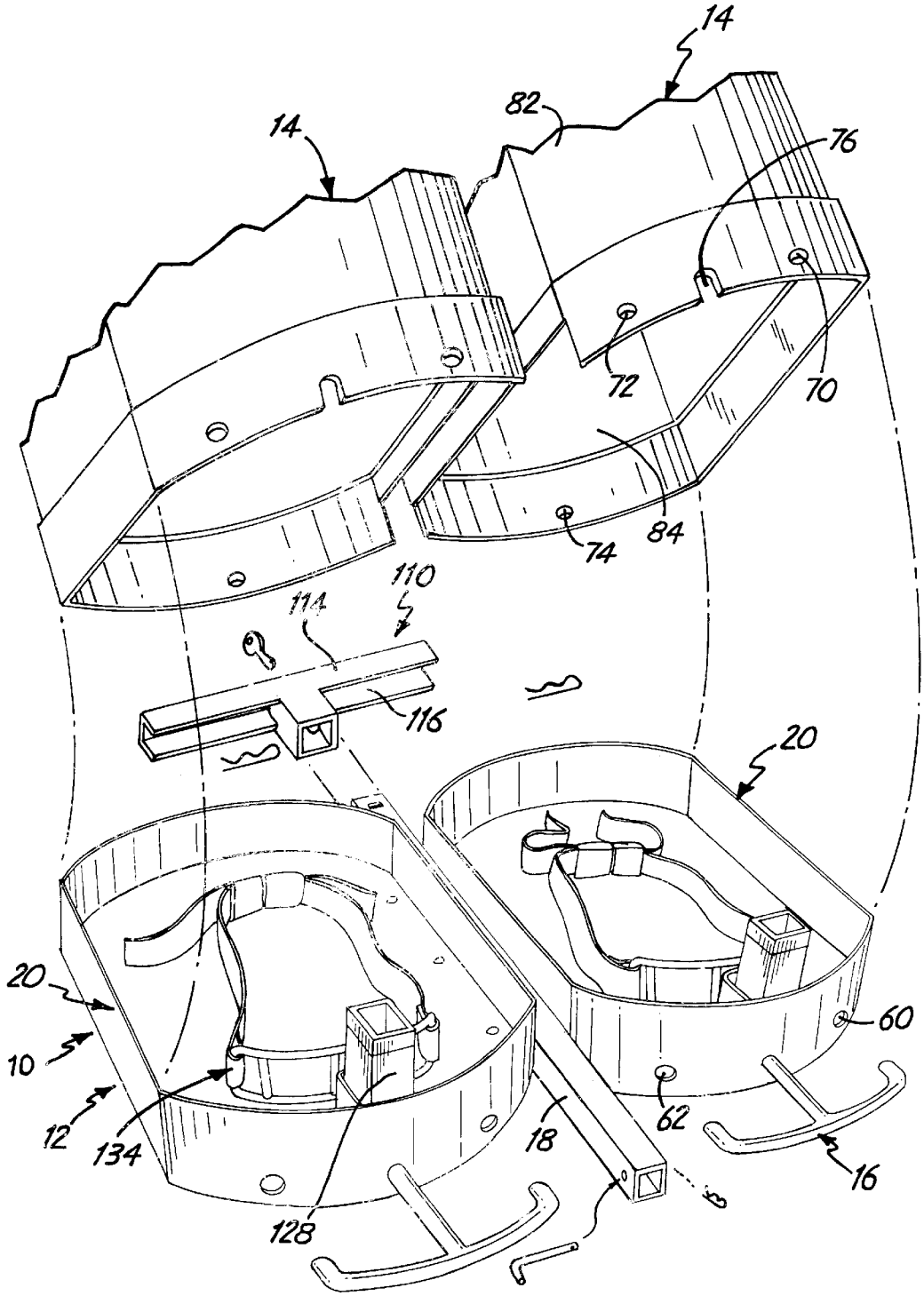
FIG. 4 is an exploded isometric view of a portion of the travel system shown in FIG. 1, with the cover removed from the base.
Figure 5:
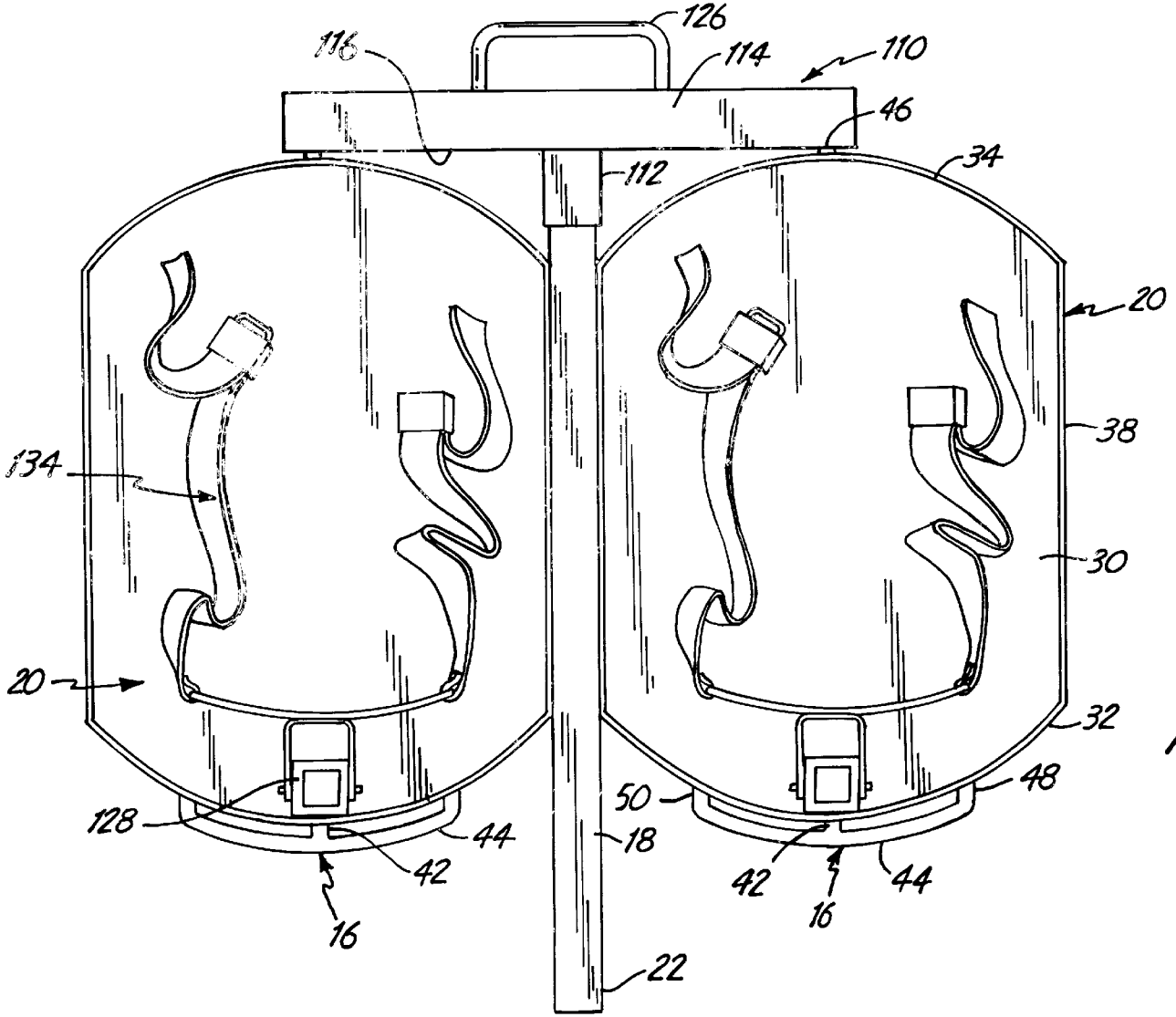
FIG. 5 is a top view of the base assembly.

The present invention is a multi-mode golf bag travel system which can be used in both a vehicle-mounted mode and/or a travel mode. A vehicle-mounted mode golf bag travel system 10 in accordance with one embodiment of the invention is illustrated generally in FIGS. 1–8. The illustrated embodiment of the system 10 is configured to carry two golf bags behind a vehicle and includes a vehicle base assembly 12, cover 14 and lock 16. Base assembly 12 includes an elongated support member 18 and two interconnected golf bag bases 20, one of which is mounted to each of the opposite sides of the support member. A golf bag support assembly 24 is mounted to each base 20, and is used to securely fasten the golf bags 26 carried by the system 10 to the base. As described in greater detail below, the covers 14 are preferably hard shell elements, and have openings at their bottom ends 28 which are sized to mate with and releasably engage the golf bag bases 20. Lock 16 is a multi-point device which releasably secures the covers 14 to the bases 20.

The base assembly 12 is adapted to be removably mounted to a car or other vehicle. Accordingly, in the embodiment shown, the support member 18 has a mounting end 22 which can be conveniently secured to and removed from a conventional trailer hitch receiver. Through the use of an adapter (not shown) the support member 18 can also be configured to fit a standard ball hitch. The golf bag bases 20 each include a bottom wall 30, front end wall 32, back end wall 34 and side walls 36 and 38. In the embodiment shown, the bottom walls 30 of both bases 20 are formed from one sheet of metal which extends over support member 18. The other portions of bases 20 are also sheet metal members in one embodiment, and have their interior side walls 36 mounted to bottom wall 30. Metal brackets 40 are secured to the support member 18 and the lower surfaces of the bottom walls 30 of the bases 20 to provide further structural support to the base assembly 12.

Each multi-point lock 16 includes a plurality of locking sections for releasably securing the cover 14 to the associated base 20. In the embodiment shown, the multi-point lock 16 is a generally T-shaped member having a base shaft 42 and a cross shaft 44. The cross shaft 44 has first and second locking sections 48 and 50 on its opposite sides. As shown, the first and second locking sections 48 and 50 are aligned generally parallel to the base shaft 42. A free end of the base shaft 42 functions as a third locking section 46.

Each multi-point lock 16 cooperates with holes through the base 20 and cover 14 to releasably secure the cover to the base. In particular, the each base 20 has first and second locking holes 60 and 62 on the opposite sides of its front end wall 32. A third locking hole 64 is generally centrally located on the back end wall 34. A lock slide hole 66 is generally centrally located on the front end wall 32, between the first and second locking holes 60 and 62. In the embodiment shown, the holes 60, 62, 64 and 66 are located on the walls 32 and 34 of the base 20 at a location below the bottom wall 30.

Similarly, the bottom end 28 of each cover 14 has first and second locking holes 70 and 72 on the opposite sides of its front end wall 82, and a third locking hole 74 on its back end wall 84. Locking holes 70, 72 and 74 on the cover 14 are positioned in such a manner that they will align with the corresponding locking holes 60, 62 and 64 in the base 20 when the cover is mated to the base. The cover 14 also has a lock slot 76 on the bottom end 28. The lock slot 76 is positioned to align with the lock slide hole 66 when the cover 14 is mated to the base 20.

Figure 6:
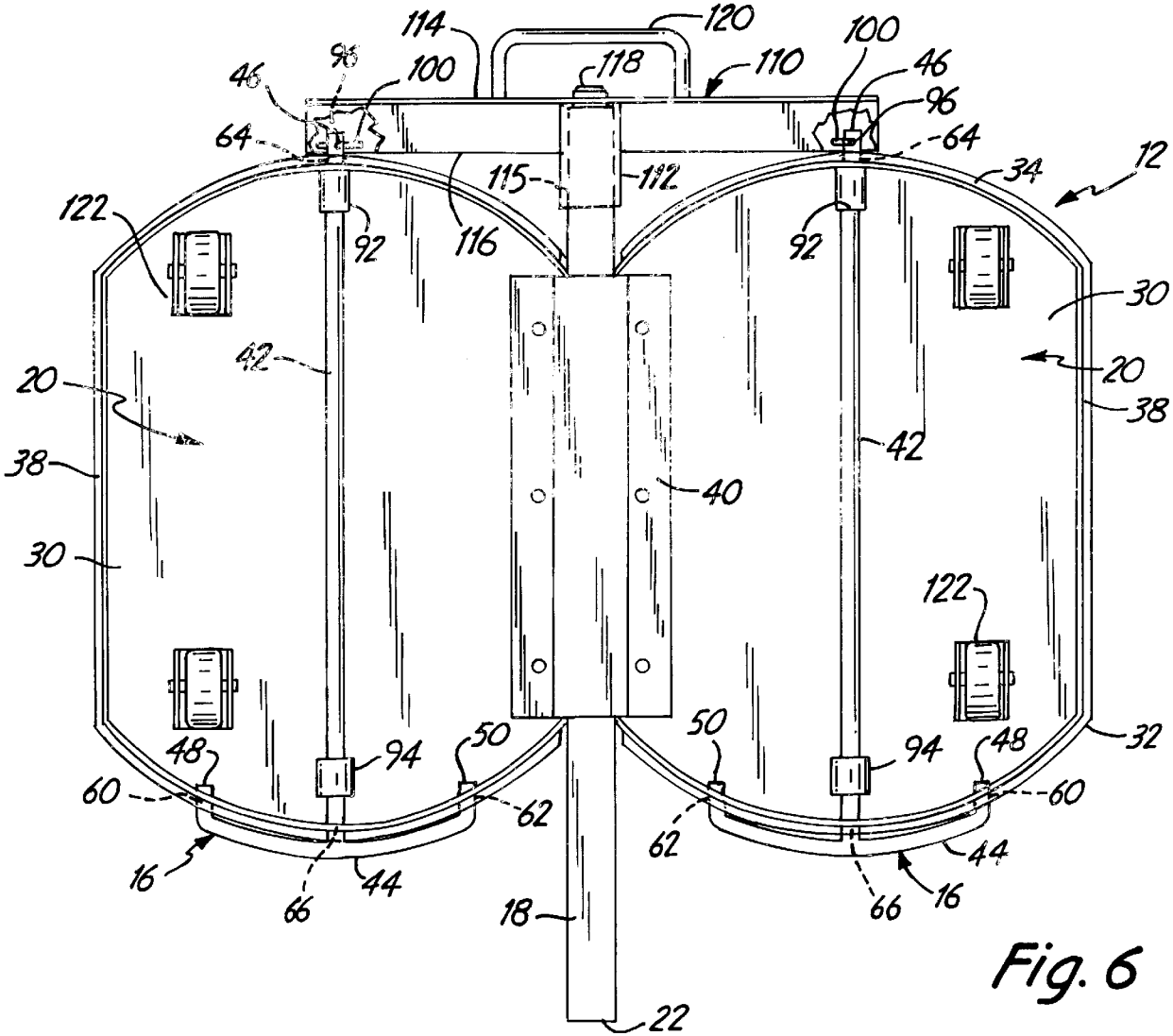
FIG. 6 is a bottom view of the base assembly.

As perhaps best shown in FIG. 6, the base shaft 42 of multi-point lock 16 extends through the third locking hole 64 and slide lock hole 66. The multi-point lock 16 is retained on the base 20 by a range-of-motion limiting bushing 92. The bushing 92 is positioned to enable the multi-point lock 16 to be withdrawn to a release position, shown in FIG. 4, at which the first, second and third locking sections 48, 50 and 46, respectively, are withdrawn from the corresponding locking holes 60, 62 and 64 of the base 20 and holes 70, 72 and 74 of the cover 14. When the multi-point lock 16 is in the release position, the cover 14 can be mated to and removed from the base 20. When the multi-point lock 16 is in the locked position shown, for example, in FIG. 6, the first, second and third locking sections 48, 50 and 46 extend through both the corresponding locking holes 60, 62 and 64 of the base 20 and holes 70, 72 and 74 of the cover 14. The multi-point lock 16 thereby secures the cover 14 to the base 20 when in the locked position. Devices such as blocks 94 can be mounted to the base shaft 42 to prevent the multi-point lock 16 from overextending and rotating, and to keep the first and second locking sections 48 and 50 aligned with the corresponding locking holes 60 and 62 of the base 20, when the multi-point lock 16 is in its release position.

The end of the base shaft 42 includes a hole 96. When the multi-point lock 16 is in its locked position, a device such as a pin 100 can be inserted through the hole 96 and retained on the base shaft 42 to prevent the multi-point lock from sliding toward its release position. Alternatively, a lock (not shown) can be inserted through the hole 96 to prevent unauthorized removal of the multi-point lock 16.

Figure 7:
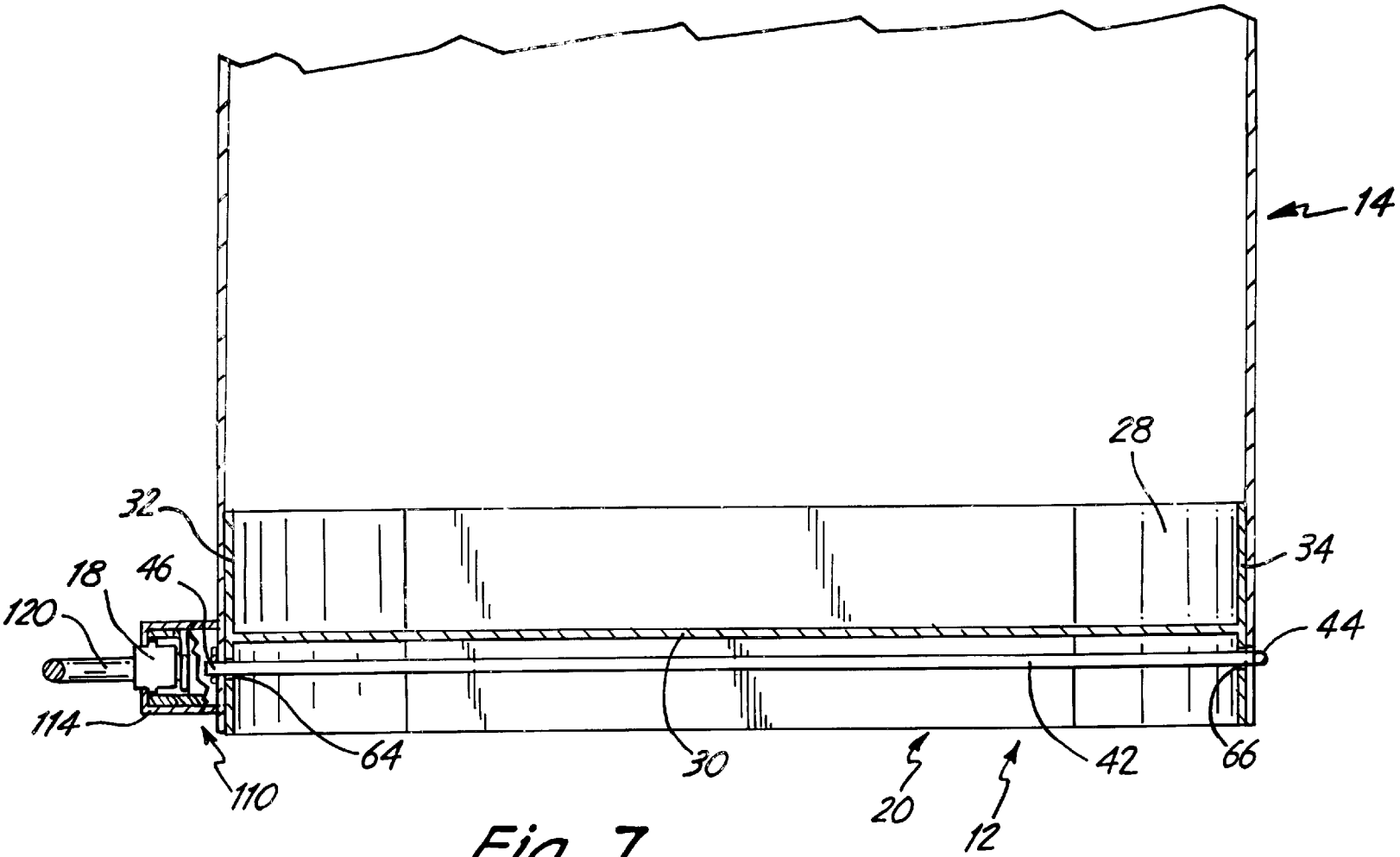
FIG. 7 is a detailed sectional view of the base assembly and access lock.
Figure 8:
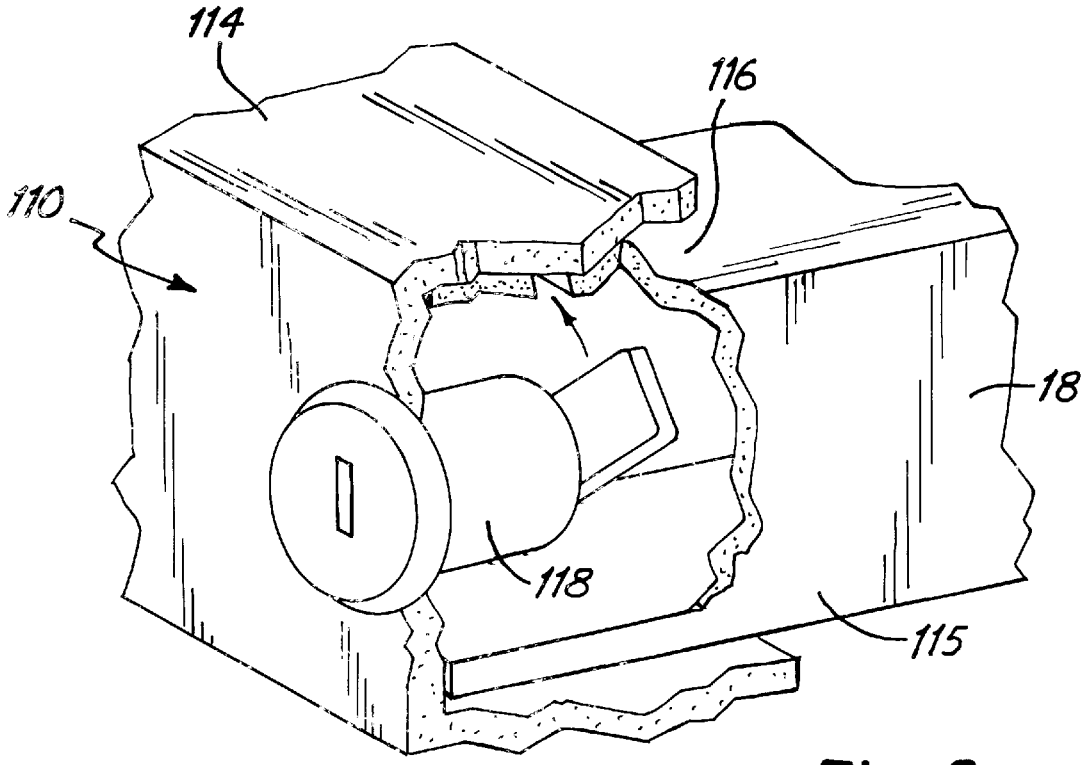
FIG. 8 is a detailed partial sectional view of the security lock of the base assembly.

Access to the pin 100 on the multi-point lock 16 can also be controlled by security lock assembly 110 to effectively provide an additional level of security. The security lock assembly 110 includes a tubular base 112 tubular cross member 114. The base 112 is sized to releasably engage the end 115 of the support member 18 on the back side of the base assembly 12. The cross member 114 is mounted to the base 112 and is closed on its ends and sides with the exception of the side 116 facing the third locking section 46 of the multi-point lock 16. When the base 112 is engaged with the end 115 of the support member 18, the third locking section 46 of the multi-point lock 16 and the pin 100 through the hole 96 extend into the cross member 114 through its open side 116. As shown in FIGS. 7 and 8, a lock 118 mounted to the cross member 114 can be used to releasably secure the security lock assembly 110 to the support member 18, thereby preventing access to the pins 100 and effectively locking the multi-point lock 16 to the golf bag base 20 and cover 14. When the lock 18 is unlocked, the security lock assembly 110 can be removed to permit access to the multi-point lock 16. A handle 120 on the back side of the cross member 18 enables the security lock assembly 110 to be conveniently engaged with and removed from the remaining portions of the base assembly 12.

As shown in FIG. 6, castor wheels 122 can be mounted to the lower surface of the bottom walls 30 of the golf bag bases 20. When the base assembly 12 is removed from a vehicle, the wheels 122 support the assembly above the ground and enable the assembly to be conveniently moved to and from its storage position.

The illustrated embodiment of each golf bag support assembly 24 includes a base 128 and post 130. Base 128 is mounted to the bottom wall 30 of the golf bag base 20 and is adapted to removably receive the post 130. Removable fasteners such as pins 132 can be used to secure the post 130 to the base 128. Buckled straps 134 are mounted to the base 128 and top of the post 130, and can be used in a conventional manner to secure a golf club bag 26 to the base assembly 12 during travel.

Covers 14 are preferably hard shell members molded from polymers such as linear low density polyethylene. As shown, the covers 14 include two handles 140 and 142. Handle 140 is located on the back end wall 82 of the cover 14, generally midway between the bottom end 28 and top end 146 of the cover. Handle 142 is also located generally on the back end wall 82 of the cover 14, but is adjacent to the top end of the cover. Both handles 140 and 142 are effectively molded into the cover 14. Handle 140 will generally be used to carry the cover 14 above the ground, and to position the cover over and remove the cover from the base assembly 12.

Figure 9:
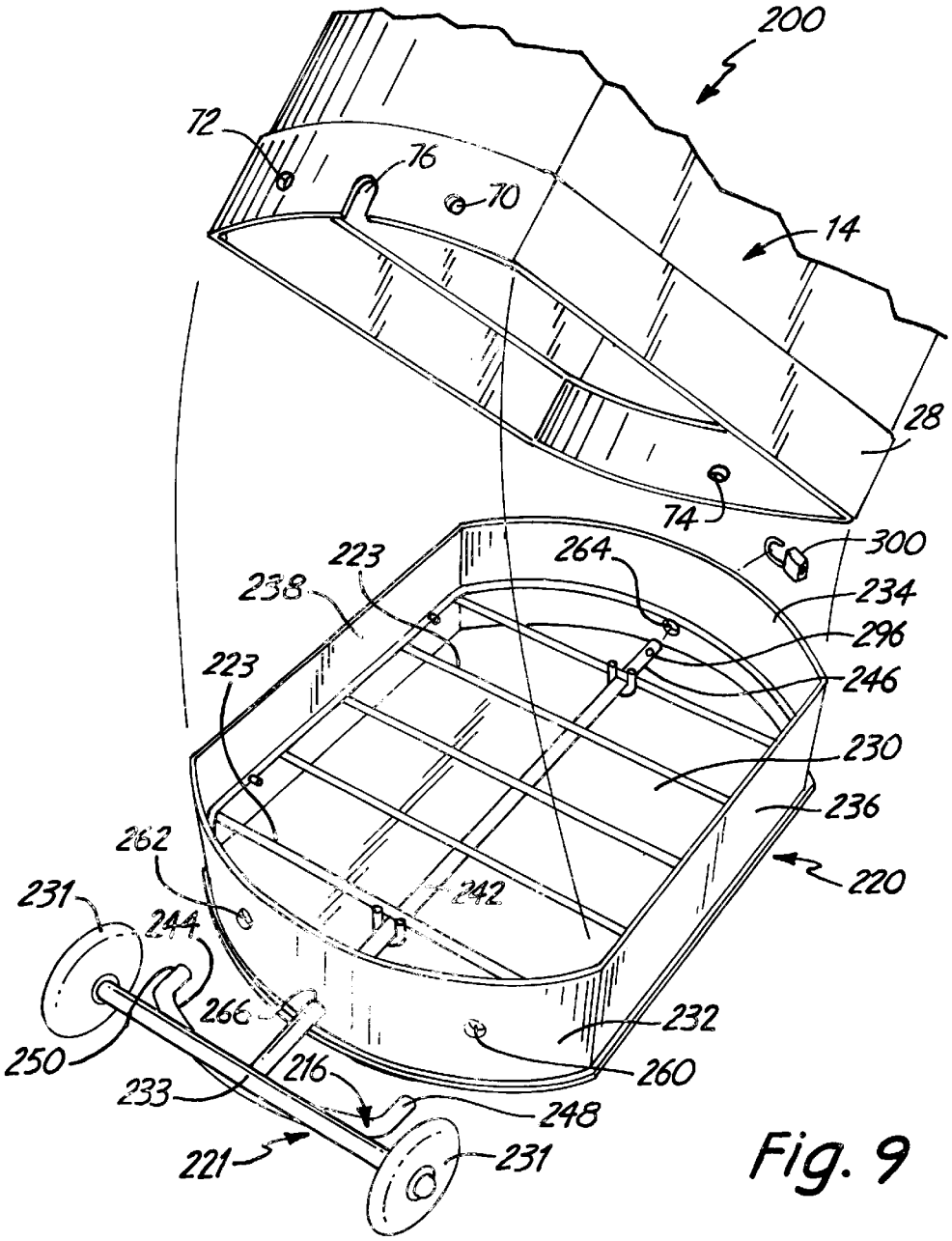
FIG. 9 is an exploded isometric view of a portion of a travel version of the multi-mode golf bag travel system of the present invention.
Figure 10:
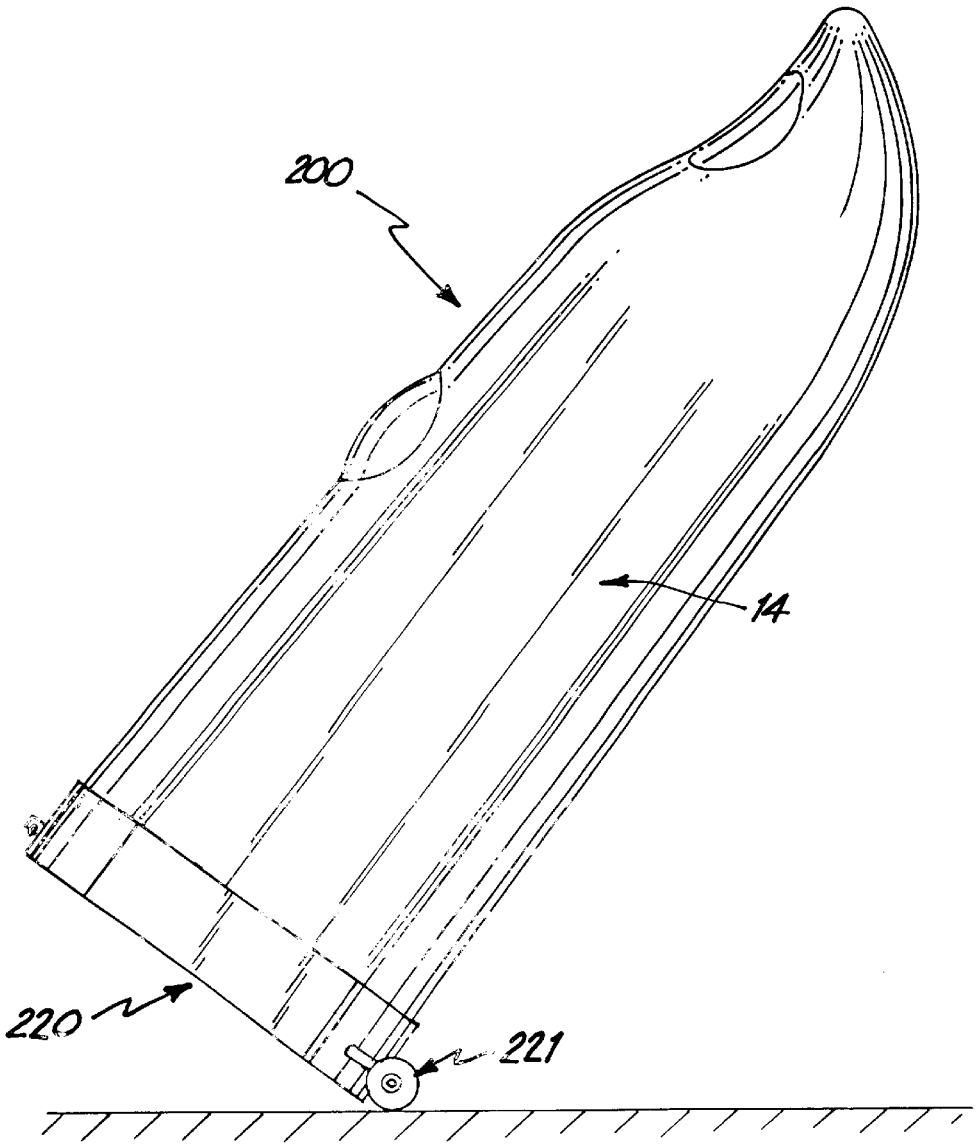
FIG. 10 is a side view of the travel version of the golf bag travel system shown in FIG. 9.

A travel mode golf bag travel system 200 in accordance with a second embodiment of the invention is shown in FIGS. 9 and 10. As shown, the travel mode system 200 includes a travel base 220, multi-point lock/wheel assembly 221 and cover such as 14. The travel base 220 includes bottom wall 230, front end wall 232, back end wall 234 and side walls 236 and 238. The base 220 can be a polymer member, molded from the same material as the cover 14. Like the vehicle golf bag base 20 described above, the travel base 220 is sized to mate with and releasably engage the bottom end 28 of the cover 14. Multi-point lock/wheel assembly 221 releasably secures the covers 14 to the base 220. A golf bag support surface, formed by bars 223 in the embodiment shown in FIG. 9, is located in the base 220 above the lock/wheel assembly 221 and bottom wall 230.

First and second locking holes 260 and 262 are located on opposite sides of the front end wall 232. A third locking hole 264 is generally centrally located on the back end wall 234. A lock slide hole 266 is generally centrally located on the front end wall 232, between the first and second locking holes 260 and 262. Locking holes 260, 262 and 264 are positioned on the travel base 220 in such a manner that they will align with the corresponding locking holes 70, 72 and 74 on the cover 14 when the cover is mated to the base. Similarly, the lock slide hole 266 is positioned to align with the lock slot 76 in the cover 14 when the cover is mated to the base 220.

Multi-point lock/wheel assembly 221 includes a lock 216 and wheels 231. Lock 216 is similar to lock 16 of the vehicle system 10 described above, and includes a plurality of locking sections for releasably securing the cover 14 to the base 220. The lock 216 is a generally T-shaped member having a base shaft 242 and a cross shaft 244. The cross shaft 244 has first and second locking sections 248 and 250 on its opposite sides. As shown, the first and second locking sections 248 and 250 are aligned generally parallel to the base shaft 242. A free end of the base shaft 242 functions as a third locking section 246. Wheels 231 are mounted to the opposite ends of an axle 233 which is welded or otherwise attached to the cross shaft 244 in the embodiment shown.

The base shaft 242 of the lock 216 extends through the third locking hole 264 and slide lock hole 266. When the multi-point lock/wheel assembly 221 is in the release position shown in FIG. 9, the first, second and third locking sections 248, 250 and 246, respectively, are withdrawn from the corresponding locking holes 260, 262 and 264 of the base 220 and the holes 70, 72 and 74 of the cover 14. The cover 14 can be mated to and released from the base 220 when the multi-point lock/wheel assembly 221 is in the release position. When the multi-point lock/wheel assembly 221 is in the locked position shown in FIG. 10, the first, second and third locking sections 248, 250 and 246 extend through both the corresponding locking holes 260, 262 and 264 of the base 220 and the holes 70, 72 and 74 of the cover 14. The multi-point lock/wheel assembly 221 thereby secures the cover 14 to the base 220 when in the locked position. A lock 300 can be inserted through the hole 296 to prevent the multi-point lock/wheel assembly 221 from moving toward its release position and to prevent unauthorized removal of the multi-point lock/wheel assembly.

As shown in FIG. 10, when the cover 14 is secured to the base 220 by the multi-point lock/wheel assembly 221, the wheels 231 will be located near the bottom of the travel mode system 200, on the side opposite the handle 142. By grasping the handle 142 and tilting the cover 14 in the direction of the wheels 231, the base 220 will be supported above the ground by the wheels. A user can then conveniently pull the travel system 200 and any golf club bag and/or other articles contained within the system. The travel system 200 can be stored lying on the sides of cover 14, or upright on the bottom wall 230 of the base 220.

The golf bag travel system of the present invention offers a number of important advantages. The system is aesthetically attractive, very convenient to use, and provides a high degree of protection for golf clubs and/or other articles being stored and transported. It can also be efficiently manufactured from durable materials. The vehicle mounted version of the system can be easily transported between a storage position (e.g., in a garage) and a vehicle-mounted position. Two sets of golf clubs can be securely transported and conveniently accessed. The cover of the vehicle mounted version can also be used in the travel version. The travel version of the system enables the golf clubs and/or other articles be to conveniently transported in the same case as it is securely transported (e.g., by airplane).

Although the present invention has been described with reference to preferred embodiments, those skilled in the art will recognize that changes can be made in form and detail without departing from the spirit and scope of the invention. In particular, although described as a golf bag carrier, the invention can be used to transport other articles as well.

What is claimed is:

1. A vehicle-mounted golf bag travel system, including:

a vehicle base having a plurality of locking holes for supporting a golf bag, the base adapted to be mounted to a vehicle;

a cover having a plurality of locking holes for extending over a golf bag supported by the vehicle base, the cover adapted to be mated to the base with the base locking holes aligned with the cover locking holes; and a multi-point lock including a plurality of locking sections, the lock movable between a locked position at which each of the locking sections extends through an aligned base and cover locking hole to removably secure the cover to the base, and a release position at which each of the locking sections is withdrawn from the aligned base and cover locking hole to enable the cover to be removed from the vehicle base.

2. The vehicle-mounted golf bag travel system of claim 1 wherein:

the base has first and second opposite ends having locking holes;

the cover has first and second opposite ends having locking holes; and the lock includes first and second locking sections for extending through the aligned base and cover locking holes on the first and second opposite ends of the base and cover.

3. The vehicle-mounted golf bag travel system of claim 1 wherein:

the base has a wall with first and second opposite sides having locking holes;

the cover has a wall with first and second opposite sides having locking holes; and the lock further includes first and second locking sections for extending through the aligned base and cover locking holes on the first and second opposite sides of the walls of the base and cover.

4. The vehicle-mounted golf bag travel system of claim 1 and further including a security lock for preventing unauthorized removal of the lock when the lock is in the locked position.

5. The vehicle-mounted golf bag travel system of claim 1 and further including a second vehicle base, a second cover, and a second multi-point lock.

6. The vehicle-mounted golf bag travel system of claim 1 wherein the cover is a one-piece molded member having integral handles.

7. The vehicle-mounted golf bag travel system of claim 1 wherein:

the base includes:

first and second opposite walls;

first and second locking holes on opposite sides of the first wall; and a third locking hole on the second wall; and the cover includes:

first and second opposite walls;

first and second locking holes on opposite sides of the first wall; and a third locking hole on the second wall; and the lock includes:

a cross shaft having first and second locking sections on its opposite ends, the first and second locking sections extending through and engaging the aligned first and second locking holes on the cover and base when the lock is in the locked position; and a base shaft extending from the cross shaft and having a third locking section on its free end, the third locking section extending through and engaging the aligned third locking holes of the cover and base when the lock is in the locked position.

8. The vehicle-mounted golf bag travel system of claim 7 wherein the lock is a T-shaped member.

9. The vehicle-mounted golf bag travel system of claim 7 and further including a security lock for preventing unauthorized removal of the lock.

10. The vehicle-mounted golf bag travel system of claim 7 wherein:

the base further includes a lock slide hole in the first wall;

the cover further includes a lock slot aligned with the lock slide hole of the base when the cover is mated to the base; and the base shaft of the lock extends through the lock slide hole of the base and the lock slot of the cover when the cover is mated to the base.

11. The vehicle-mounted golf bag travel system of claim 10, wherein the lock is a T-shaped member.

12. The vehicle-mounted golf bag travel system of claim 10, wherein:

the base shaft of the lock includes a releasable restraining mechanism at the free end for preventing the lock from being moved from the locked position to the release position, and the security lock prevents unauthorized access to the releasable restraining mechanism on the base shaft of the lock.

13. The vehicle-mounted golf bag travel system of claim 12, wherein:

the system further includes a support shaft configured to be releasably mounted to a vehicle;

the base is mounted to the support shaft; and the security lock is releasably locked to the support shaft.

14. A multi-mode golf bag travel system, including:

a vehicle base adapted to be mounted to a vehicle, for receiving a golf bag;

a travel base having wheels, for receiving a golf bag;

a hard shell cover having an opening at a first end which mates with both the vehicle base and the travel base, and a handle adjacent to a second end, for enclosing a golf bag; and a locking mechanism for securing the hard shell cover to the vehicle base when used in a vehicle mode, and for securing the cover to the travel base when used in a travel mode.

15. The multi-mode golf bag travel system of claim 14 wherein the cover is a one-piece molded member having an integral handle.

16. The multi-mode golf bag travel system of claim 14, wherein:

the vehicle base has a plurality of locking holes;

the travel base has a plurality of locking holes;

the cover has a plurality of locking holes which align with the locking holes on the vehicle base when the cover is mated to the vehicle base and align with the locking holes on the travel base when the cover is mated to the travel base; and the lock is a multi-point lock having a plurality of locking sections, the lock movable between a locked position at which each of the locking sections extends through an aligned base and cover locking hole to removably secure the cover to the base, and a release position at which each of the locking sections is withdrawn from the aligned base and cover locking hole to enable the cover to be removed from the vehicle base.

17. The multi-mode golf bag travel system of claim 16 wherein the wheels are mounted to the multi-point lock.

18. A golf bag travel system, including:

a travel base having wheels and a plurality of locking holes, for receiving a golf bag;

a hard shell cover having an opening at a first end which mates with the travel base, a handle adjacent to a second end, and a plurality of locking holes which align with the locking holes on the travel base when the cover is mated to the travel base, for enclosing the golf bag; and a locking mechanism operated with the locking holes on the hard shell cover and the locking holes on the travel base for securing the hard shell cover to the travel base.

19. The golf bag travel system of claim 18 wherein the locking mechanism is a multi-point lock having a plurality of locking sections, the lock movable between a locked position at which each of the locking sections extends through an aligned base and cover locking hole to removably secure the cover to the travel base, and a release position at which each of the locking sections is withdrawn from the aligned base and cover locking hole to enable the cover to be removed from the travel base.

20. The golf bag travel system of claim 18 wherein the wheels are mounted to the locking mechanism.

* * * * *